US007578010B2

(12) United States Patent
Goettl

(10) Patent No.: US 7,578,010 B2
(45) **Date of Patent: *Aug. 25, 2009**

(54) METHOD FOR OPERATING A POP-UP CLEANING NOZZLE FOR A POOL OR SPA

(75) Inventor: John M. Goettl, Phoenix, AZ (US)

(73) Assignee: Paramount Leisure Industries, Inc., Tempe, AZ (US)

( * ) Notice: Subject to any disclaimer, the term of this patent is extended or adjusted under 35 U.S.C. 154(b) by 276 days.

This patent is subject to a terminal disclaimer.

(21) Appl. No.: 10/930,494

(22) Filed: Aug. 31, 2004

(65) Prior Publication Data

US 2005/0023373 A1 Feb. 3, 2005

Related U.S. Application Data

(62) Division of application No. 10/406,333, filed on Apr. 3, 2003, now Pat. No. 6,848,124.

(51) Int. Cl.
*E04H 4/16* (2006.01)

(52) U.S. Cl. ..... 4/490; 239/236; 239/239; 74/129

(58) Field of Classification Search ..... 4/490, 4/661; 239/99, 201, 204, 205, 236, 241, 239/242, 206, 239; 74/129
See application file for complete search history.

(56) References Cited

U.S. PATENT DOCUMENTS 1,821,579 A 9/1931 Rader ..... 239/206
1,964,269 A 6/1934 Munz ..... 239/521
2,209,961 A * 8/1940 De Lacy-Mulhall ..... 239/242 X
2,214,852 A 9/1940 De Lacy-Mulhall ..... 239/204

(Continued)

OTHER PUBLICATIONS

CSI, Leaf Trapper Main Drain System Installation Bulletin, no publication year listed, 8 pgs.

*Primary Examiner*—Robert M Fetsuga
(74) *Attorney, Agent, or Firm*—Booth Udall, PLC

(57) ABSTRACT

A recessed incrementally rotating nozzle assembly is located in a wall or bottom surface of a swimming pool in fluid communication through a conduit with a source of water under pressure from a valve, which valve periodically releases water into the conduit. Each time water flows, a nozzle housing is raised to eject a stream of water. As the nozzle housing rises, it is incrementally rotated by a pin engaging a saw tooth member of a cam ring. Upon cessation of flow, the nozzle housing is retracted and during retraction the nozzle housing is further incrementally rotated by the pin engaging another saw tooth member of the cam ring. After a predetermined degree of angular rotation, a cam reverser slidably reorients protrusions guiding the pin into and out of the saw tooth members to cause the pin to be guided by the opposite side of the saw tooth members and thereby cause reversal of the direction of rotation of the nozzle housing. After the predetermined degree of rotation in the reverse direction has occurred, the direction of rotation is again reversed by the cam reverser. The angle through which rotation occurs is readily adjusted by substituting an appropriately configured pattern cam. The fan of water streams ejected may be readily reoriented to correspond with an area of interest by unlocking the position of a cam ring, angularly reorienting the cam ring and locking it in its new position.

1 Claim, 4 Drawing Sheets

U.S. PATENT DOCUMENTS

| | | | | |
|---|---|---|---|---|
| 3,237,866 | A | 3/1966 | Lovell | 239/204 |
| 3,247,968 | A | 4/1966 | Miller | 4/490 |
| 3,247,969 | A | 4/1966 | Miller | 210/169 |
| 3,408,006 | A | 10/1968 | Stanwood | 239/66 |
| 3,449,772 | A | 6/1969 | Werner | 4/490 |
| 3,486,623 | A | 12/1969 | Bosico | 210/169 |
| 3,506,489 | A | 4/1970 | Baker | 134/10 |
| 3,515,351 | A | 6/1970 | Costa | 239/206 |
| 3,521,304 | A | 7/1970 | Ghiz | 4/490 |
| 3,567,127 | A | 3/1971 | Raumaker | |
| 3,675,252 | A | 7/1972 | Ghiz | 4/492 |
| 3,765,608 | A | 10/1973 | Lockwood | 239/230 |
| 3,955,764 | A | 5/1976 | Phaup | 239/206 |
| 4,114,206 | A | 9/1978 | Franc | 4/490 |
| 4,188,673 | A | 2/1980 | Carter | 4/490 |
| 4,193,870 | A | 3/1980 | Goodin | 210/805 |
| 4,195,371 | A | 4/1980 | Goodin | 4/490 |
| 4,200,230 | A | 4/1980 | Gould | 239/66 |
| 4,202,499 | A | 5/1980 | Mathews | 239/206 |
| 4,212,088 | A | 7/1980 | Goettl et al. | 4/490 |
| 4,271,541 | A | 6/1981 | Mathews | 4/490 |
| 4,276,163 | A | 6/1981 | Gordon | 210/136 |
| 4,322,860 | A | 4/1982 | Gould | 4/490 |
| 4,347,979 | A | 9/1982 | Mathews | 239/206 |
| 4,371,994 | A | 2/1983 | Mathews | 4/490 |
| 4,391,005 | A | 7/1983 | Goettl | 4/490 |
| 4,462,546 | A | 7/1984 | Pitman | 239/97 |
| 4,466,142 | A | 8/1984 | Gould | 4/490 |
| 4,471,908 | A | 9/1984 | Hunter | 239/11 |
| 4,520,514 | A | 6/1985 | Johnson | 4/490 |
| 4,568,024 | A | 2/1986 | Hunter | 239/242 |
| 4,592,379 | A | 6/1986 | Goettl | 137/119.07 |
| 4,681,259 | A | 7/1987 | Troup et al. | |
| 4,939,797 | A | 7/1990 | Goettl | 4/490 |
| 5,048,758 | A | 9/1991 | Jackerson | |
| 5,135,579 | A | 8/1992 | Goettl | 134/10 |
| 5,251,343 | A | 10/1993 | Goettl | 4/490 |
| 5,333,788 | A | 8/1994 | Hadar | 239/241 |
| 5,826,797 | A | 10/1998 | Kah, III | 239/344 |
| 5,975,430 | A | 11/1999 | Larsen | |
| 6,029,907 | A | 2/2000 | McKenzie | 239/240 |
| 6,085,995 | A | 7/2000 | Kah, Jr. et al. | 239/237 |
| 6,182,909 | B1 | 2/2001 | Kah, Jr. et al. | 239/206 |
| 6,237,862 | B1 | 5/2001 | Kah, III et al. | 239/391 |
| 6,301,723 | B1 | 10/2001 | Goettl | 4/490 |
| 6,367,098 | B1 | 4/2002 | Barnes | 4/490 |
| 6,393,629 | B1 | 5/2002 | Barnes et al. | 4/490 |
| 6,438,766 | B1 | 8/2002 | Capdevila Arnau et al. | 4/490 |
| 6,848,124 | B2 * | 2/2005 | Goettl | 4/490 |

* cited by examiner

ROTATION
REVERSER TRAVEL
EXTENDED
PIN TRAVEL
RETRACTED
46
48
50
110
112
114
116
118
120
122

46
48
50
110a
112a

METHOD FOR OPERATING A POP-UP CLEANING NOZZLE FOR A POOL OR SPA

CROSS REFERENCE TO RELATED APPLICATIONS

The present applications is a divisional application of a patent application entitled CAM OPERATED POP-UP SWIMMING POOL CLAENING NOZZLE filed Apr. 3, 2003 and assigned Ser. No. 10/406,333, now U.S. Pat. No. 6,848,124, issued Feb. 1, 2005, and describing an invention made by the present inventor and assigned to the present assignee.

BACKGROUND OF THE INVENTION

Presently existing erectable nozzles mounted in the bottom and/or side walls of a swimming pool are generally flush with the adjacent surface. These nozzles are in fluid communication through one or more conduits and a valve assembly for selectively channeling a flow of water from a pump to a respective one or more of the nozzles. Upon flow of water to a nozzle, the resulting water flow will erect the nozzle and a stream of water will be discharged. The stream of water may be oriented generally along the adjacent surface or at an angle with respect thereto. The nozzles may rotate incrementally in one direction or continuously in order for the ejected stream of water to wash/scrub the adjacent surface in a fan like planform from the nozzle.

The pattern of a discharged stream of water is generally effective when the adjacent surface of a swimming pool is essentially planar. However, most swimming pools have surfaces angled with respect to one another, which angled surfaces disrupt or deflect a washing/scrubbing stream of water. As a result of such deflection(s), dead spots of water flow adjacent the surface occurs. Debris tends to collect in such dead spots. A solution to this problem is that of having a very large number of nozzles but the costs of installation would become unacceptable. Moreover, a significantly larger pump and actuating motor would have to be employed at significant extra cost in order to provide the requisite water flow rate and volume.

BRIEF SUMMARY OF THE INVENTION

A pop-up cleaning nozzle for a swimming pool includes a cam operated mechanism for sequentially stepping the rotation of the nozzle through a predetermined number of degrees as a function of sequential water flow to the nozzle from a valve assembly associated with a pump. Upon reaching the end of a predetermined number of degrees of rotation, the direction of rotation is automatically reversed. A locking mechanism accommodates orientation of the angular fan-like discharge area to permit orienting the washing/scrubbing action of the ejected sequential streams of water to a particular area of interest. By selecting an appropriate cam pattern, the size of the angle through which the nozzle is stepped may be controlled to also focus the streams of washing/scrubbing water on areas of particular interest.

It is therefore a primary object of the present invention is to provide a pop-up cleaning nozzle for a swimming pool which incrementally steps through a predetermined angle and then incrementally steps in the reverse direction.

Another object of the present invention is to provide a pop-up nozzle for cleaning a swimming pool which automatically reverses direction at the end of travel through a predetermined angle.

Still another object of the present invention is to provide a pop-up cleaning nozzle for a swimming pool which permits a lockable adjustment of the orientation of the angle through which an incremental stream of cleaning water is stepped.

Still another object of the present invention is to provide a pop-up nozzle which permits a change of the degrees of the angle through which the nozzle is stepped by changing a cam pattern.

A further object of the present invention is to provide a pop-up nozzle for cleaning a swimming pool which, in response to each periodic inflow if water, incrementally steps through a predetermined angle and then reverses direction.

A still further object of the present invention is to provide a method for orienting a pop-up cleaning nozzle for a swimming pool to wash/scrub a predetermined surface area of interest.

A still further object of the present invention is to provide a method for cleaning a swimming pool with a pop-up nozzle which reverses the incremental direction of rotation upon reaching the end of a predetermined angle of rotation.

A yet further object of the present invention is to provide a method for easily changing the degree of angular excursion of the stream of washing/scrubbing water discharged from an incrementally rotating pop-up nozzle mounted in a swimming pool.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE INVENTION

Figure 1:
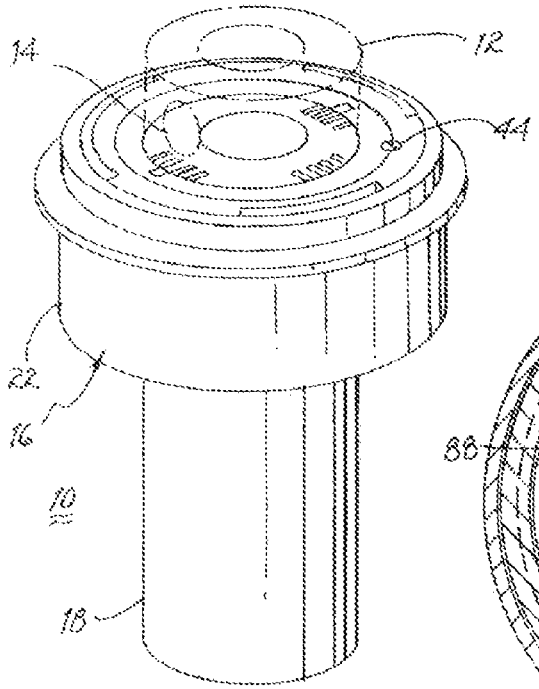
FIG. 1 is a perspective view illustrating the nozzle pop-up assembly of the present invention.
Figure 2:
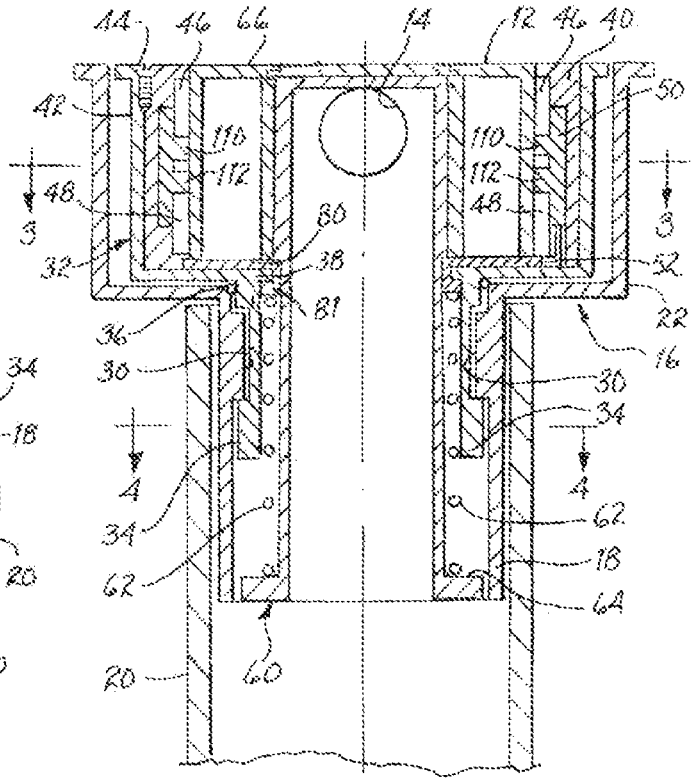
FIG. 2 is a cross sectional view of the nozzle assembly shown in the retracted state.

A recessed incrementally rotating nozzle assembly 10 for use in swimming pools and the like is illustrated in FIG. 1. In the retracted position, the upper surface of the nozzle assembly is essentially flush with the adjacent swimming pool surface. The extended position of nozzle housing 12 is shown in dashed lines and includes an outlet 14 through which a stream of water is ejected. Body 16 includes a hollow cylinder 18 for attachment to the interior of a conduit 20 (see FIG. 2) periodically supplying water under pressure to the nozzle assembly. A diametrically enlarged section 22 is supported by and extends from cylinder 18. As shown in FIG. 2, cylinder 18 includes a plurality of lugs 30 disposed on the interior surface thereof. A retainer 32, for retaining the operative elements of the nozzle assembly within body 16, includes a plurality of lugs 34 extending radially outwardly for locking engagement with lugs 30 upon passing the lugs of the retainer axially past the lugs of cylinder 18 and rotating the retainer to bring about locking engagement. An O-ring 36 or the like is disposed between the retainer and the cylinder to prevent water flow therebetween. A cam ring 40 is rotatably lodged within radially expanded section 42 of retainer 32. Rotation of the cam ring relative to section 42 is prevented by a screw 44, or the like, threadedly inserted between cam ring 40 and section 42. A plurality of downwardly pointing saw tooth members 46 extended downwardly along the upper part of cam ring 40. A similar plurality of upwardly pointing saw tooth members 48 extend upwardly along cam ring 40. A ring-like cam reverser 50 is slidably lodged adjacent cam ring 40 and is circumferentially slidably captured between saw tooth members 46,48. An arm 52 extends downwardly and radially inwardly from the cam reverser. Further details attendant the structure and operation of the saw tooth members, the cam reverser and the arm will be described in greater detail with reference to the remaining figures.

A sleeve 60 is vertically translatable upwardly within cylinder 18 in response to water pressure present within conduit 20. Such vertical translation is resisted by a coil spring 62 bearing against an annular lip 64 of the sleeve, a lip 81 associated with a pattern cam 80, and the retainer 32. Nozzle housing 12 is supported upon sleeve 60 and defines an outlet 14 through which a stream of water is ejected upon upward translation of the sleeve. In the absence of water pressure within conduit 20, coil spring 62 will draw sleeve 60 and nozzle assembly 12 downwardly to the retracted position shown in FIG. 2. A pair of diametrically opposed pins 70,72 extend radially outwardly from nozzle housing 12 for sliding engagement with sets of saw tooth members 46, 48, which engagement will cause nozzle housing 12 to rotate incrementally each time it is extended and retracted, as will be described in further detail below.

A pattern cam 80 is vertically positionally fixed upon radially extending shoulder 38 formed as part of retainer 32. It includes lip 81 extending around the interior edge of shoulder 38. The pattern cam is configured to determine the angular extent of reciprocating rotation of nozzle housing 12. Generally, it may define an angle of reciprocating rotation of 180 degrees or ninety degrees; however, for a particular location of the nozzle assembly within a swimming pool, a greater or lesser angle of reciprocating rotation may be selected to ensure washing/scrubbing of the swimming pool surface of interest.

Figure 3:
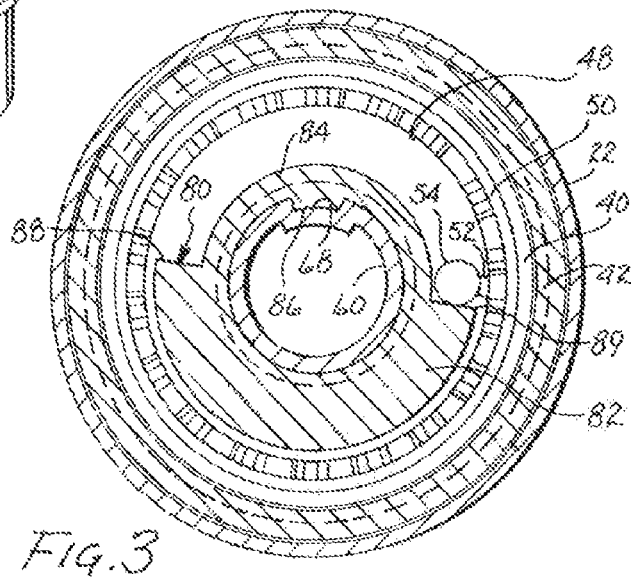
FIG. 3 is a cross sectional view taken along lines 3-3, as shown in FIG. 2.
Figures 6, 6A:
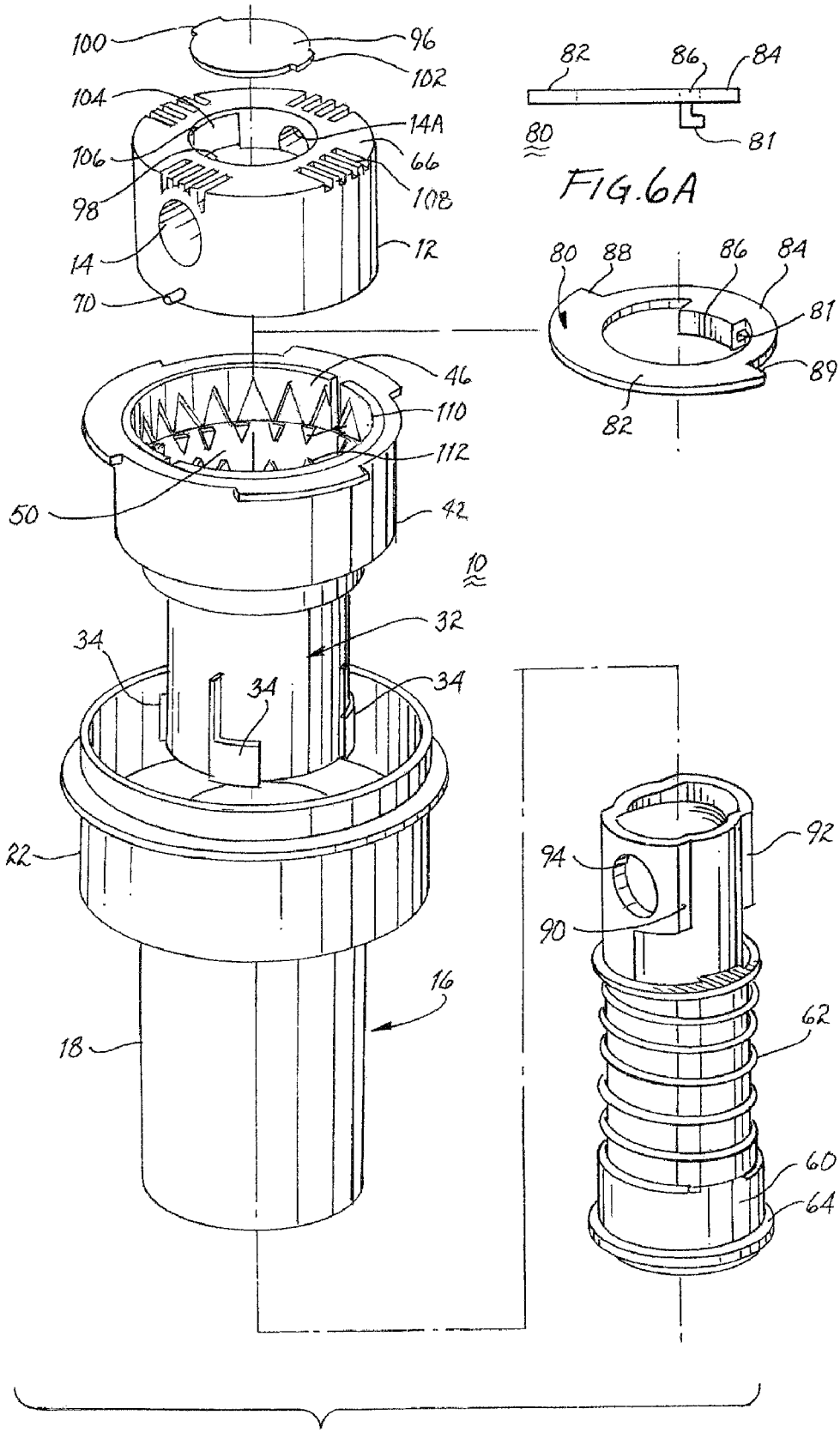
FIG. 6 is an exploded view illustrating various of the components of the nozzle assembly.
FIG. 6A is a side view of the pattern cam shown in FIG. 6.

Referring to FIGS. 3, 6 and 6A pattern cam 80 and its operation will be discussed. Sleeve 60 includes a keyway 68 to serve in the manner of an index. Pattern cam 80 includes an annular arc 84 extending from semi-circular disc 82, the combination of which surrounds sleeve 60. Annular arc 84 includes a key 86 mating with keyway 68 of sleeve 60; thereby, the pattern cam is indexed with the sleeve and will rotate commensurate with nozzle housing 12, also fixedly attached to the sleeve. Arm 52 is terminated by a flat roundel 54 disposed in the horizontal plane of disc 82. As sleeve 60 rotates in response to pins 70, 72 sequentially contacting saw tooth members 46, 48, pattern cam 80 will rotate commensurately. When one of edges 88, 89 of disc 82, such as edge 89, contacts roundel 54 as the disc rotates in, for instance, a counterclockwise direction as viewed in FIG. 3, the force of edge 89 acting upon roundel 54 will cause the roundel, arm 52 and cam reverser 50 to be repositioned incrementally counter clockwise as a function of the spacing between adjacent saw tooth members (see FIG. 2). The resulting repositioning of the cam reverser will result in a change in direction of rotation of sleeve 60 along with attached nozzle housing 12. On the completion of incremental steps of rotation, edge 88 of disc 82 will contact the other side of roundel 54 and cause it to be translated incrementally. Such translation of the roundel is translated via arm 52 to cam reverser 50 and the rotation of sleeve 60 and nozzle housing 12 will change direction.

Figure 4:
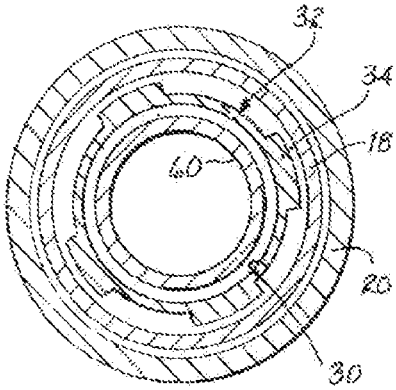
FIG. 4 is a cross sectional view taken along lines 4-4, as shown in FIG. 2.

FIG. 4 primarily illustrates lugs 34 of retainer 32 in engagement with lugs 30 of cylinder 18, all of which are disposed within conduit 20.

Figure 5:
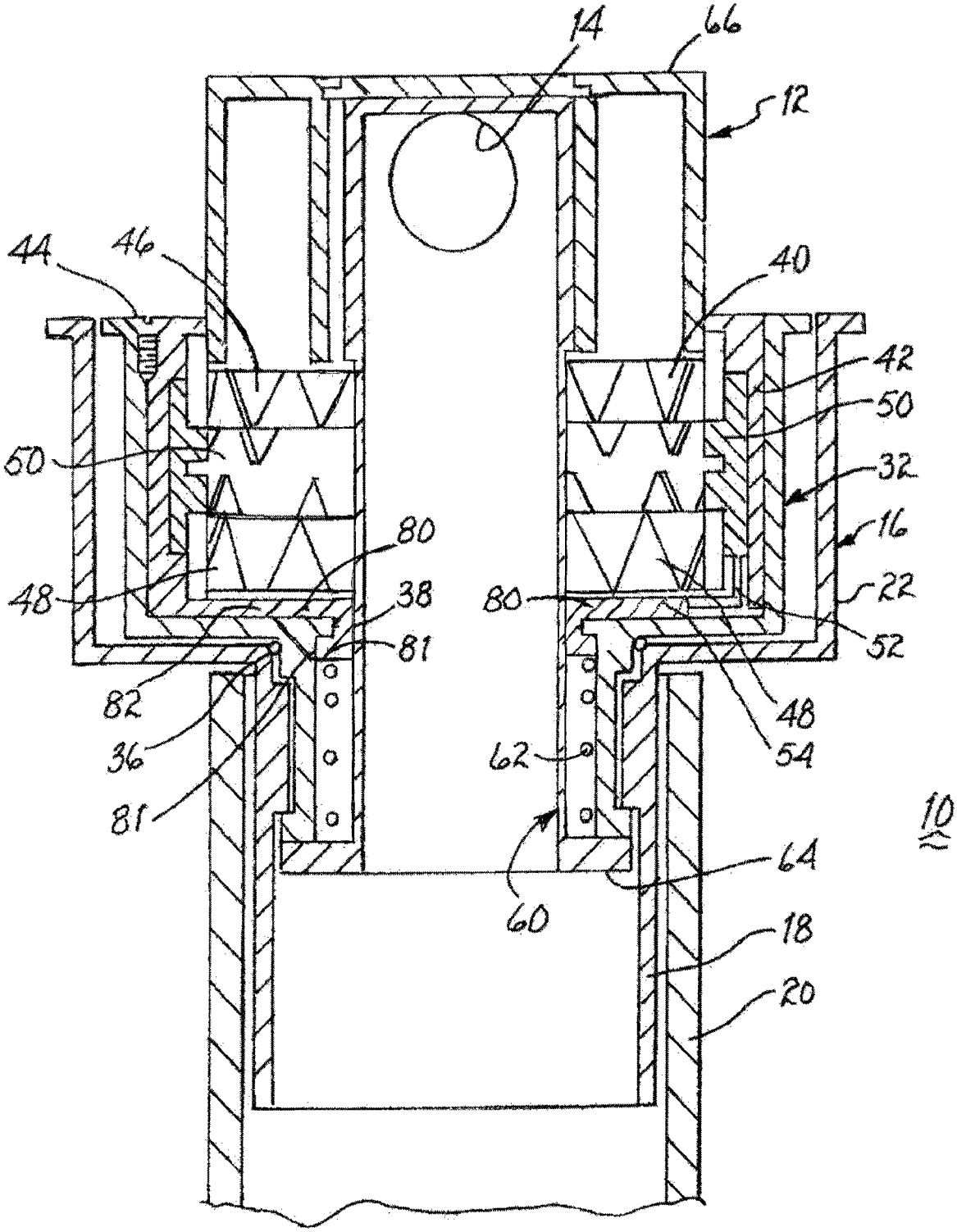
FIG. 5 is a cross sectional view illustrating the nozzle assembly in the erect state.

FIG. 5 illustrates nozzle housing 12 in the erected state. Herein, water pressure exists within conduit 20, which water pressure causes sleeve 60 to be raised against the force of coil spring 62. As the sleeve rises, it causes nozzle housing 12 to rise, as illustrated. As the nozzle housing rises, pins 70, 72 rise in the spaces intermediate saw tooth members 46. Because the pins bear against the saw tooth members, which saw tooth members have slanted opposed sides, as illustrated, the pins are caused to be angularly translated about the vertical axis of nozzle 10 and nozzle housing 12 will rotate incrementally a corresponding angular distance. When water pressure within conduit 20 is terminated, the force of coil spring 62 will cause sleeve 60 to become retracted and the nozzle housing 12 will be lowered within section 22, as shown in FIGS. 1 and 2. As nozzle housing 12 is lowered, pins 70, 72 will contact the edges of saw tooth members 48 and thereby cause the pins to be angularly translated and the nozzle housing will rotate incrementally a corresponding angular distance. The direction of rotation is controlled by cam reverser 50 and will be described in further detail with reference to FIGS. 7 and 8.

FIG. 6 is an exploded view of the primary components of nozzle assembly 10 and FIG. 6A illustrates pattern cam 80 in more detail. Sleeve 60 includes lugs 90, 92 cooperating with corresponding lugs in housing 12 that work in the manner of a bayonet fitting to lock the sleeve with the housing and upon such locking orient outlet 94 of the sleeve with either of diametrically opposed outlets 14, 14A in nozzle housing 12. A disc 96 is centrally located in the top of the nozzle housing to close opening 98, which opening is formed primarily for manufacturing purposes. The disc may include opposed lugs 100, 102 which slidably engage corresponding opposed slots, of which slot 104 is shown. A lip 106 is disposed at the top of each of the slots to prevent ejection of disc 96. The four sets of channels 108 shown in nozzle housing 12 have no functional purpose and are employed primarily for manufacturing reasons to minimize the thickness of the plastic of the nozzle housing and avoid shrinkage after manufacture. Pattern cam 80 includes a disc 82 representing approximately 180 degrees between edges 88, 89, which disc controls the angular excursion of nozzle housing 12. The angular excursion can be easily reduced to 90 degrees or to any other value by simply substituting another pattern cam having an annular extension such that the angular distance between edges 88, 89 corresponds with the angular rotation wanted of the nozzle housing.

Figure 7:
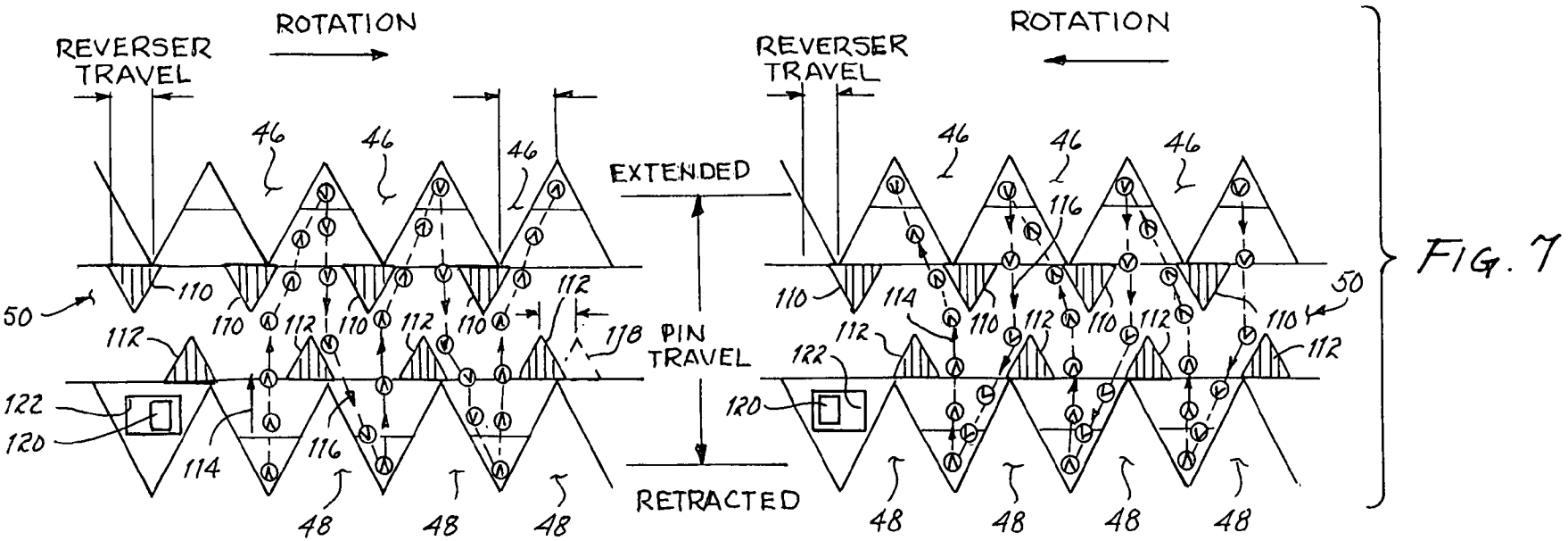
FIG. 7 illustrates the travel of a cam for incrementally rotating the nozzle.

Referring to FIG. 7, the apparatus for providing incremental rotation through a preset angular excursion and reversal of travel will be described. Saw tooth members 46, located on cam ring 40, are representatively illustrated along with saw tooth members 48 also mounted upon the cam ring. Cam reverser 50 includes a series of upper triangular in shape protrusions 110 pointed downwardly (see also FIG. 2) and a plurality of lower protrusions 112 triangular in shape and pointed upwardly. One of pins 70,72 is represented by a roundel having therein either a symbol of $\vee$ or $\wedge$. The symbol $\vee$ represents downward movement of the pin and the symbol $\wedge$ represents upward movement of the pin. When sleeve 60 is forced upwardly by water pressure within conduit 20, nozzle housing 12 and pins 70, 72 extending therefrom will travel upwardly, as represented by arrow 114, from in-between the junction of two adjacent saw tooth members 48, as depicted on the left side of FIG. 7. Upon upward movement, the pin(s) will strike protrusion 110 and be deflected to the right, as indicated. Such deflection will result in commensurate rotation of nozzle housing 12. After the pin(s) passes protrusion 110, it will be guided to the right by the edge of saw tooth member 46 until it reaches the apex. The degree of rotation of nozzle housing 12 is commensurate with the angular excursion from the initial point at the bottom of the intersection of the edges of adjacent saw tooth members 48 and the apex of the edges of the adjacent saw tooth members 46. After water pressure within conduit 20 ceases, coil spring 62 will cause retraction of sleeve 60 and nozzle housing 12. During such retraction, the pin(s) moves vertically downwardly, as represented by arrow 116, until it strikes an edge of protrusion 112. This edge will guide the pin adjacent an edge of saw tooth members 48 until it comes to rest at the bottom apex between the two adjacent saw tooth members, as illustrated. As is evident, saw tooth members 46 are offset from saw tooth members 48 by one-half of the width of the saw tooth members.

As nozzle housing 12 rotates, sleeve 60 will rotate commensurately. Such rotation of the sleeve will cause pattern cam 80 (see FIG. 3) to rotate until one of edges 88, 89 contacts roundel 54 and causes the roundel to move angularly. Such angular movement of roundel 54 is translated to commensurate rotational (angular) movement of cam reverser 50. The angular displacement of the cam reverser is depicted and represented by protrusion 118 shown in dashed lines to indicate movement of each of protrusions 112 (and protrusions 110). The resulting relationship between protrusions 110, 112 and saw tooth members 46, 48 is depicted in the right half of FIG. 7. As illustrated, the pin(s) will move upwardly from in-between saw tooth members 48 commensurate with upward movement of nozzle housing 12 upon the presence of water pressure within conduit 20. As the pin moves upwardly, it will contact protrusion 110 and be directed to the left (not to the right as formerly described). Thereafter, the pin(s) will slide along the edge of saw tooth members 46 until it reaches the apex between adjacent saw tooth members 46. Upon cessation of water pressure within conduit 20, sleeve 60 and nozzle housing 12 will retract and result in downward movement of the pin(s) until it strikes the edge of protrusion 112. This edge will guide the protrusion onto the edge of a saw tooth member 48 until it bottoms out at the apex between adjacent saw tooth members 48; this position corresponds with the retracted position of sleeve 60 and nozzle housing 12. The resulting incremental rotation of nozzle housing 12 will continue until the other edge of cam pattern 80 contacts and causes rotational movement of roundel 54 to relocate the cam reverser. To limit the rotational movement of cam reverser 50, a tab 120 extends from retainer 32 into penetrable engagement with a slot 122 formed in cam reverser 50. The movement of the slot with respect to the tab controls the degree of angular excursion of the cam reverser each time the rotational movement is changed; furthermore, the movement of the slot from one side to the other precisely controls the repositioning of protrusions 110, 112 to ensure alignment with the respective saw tooth members and thereby accurately directs the engaging pin to the corresponding edge of the respective saw tooth member.

Figure 8:
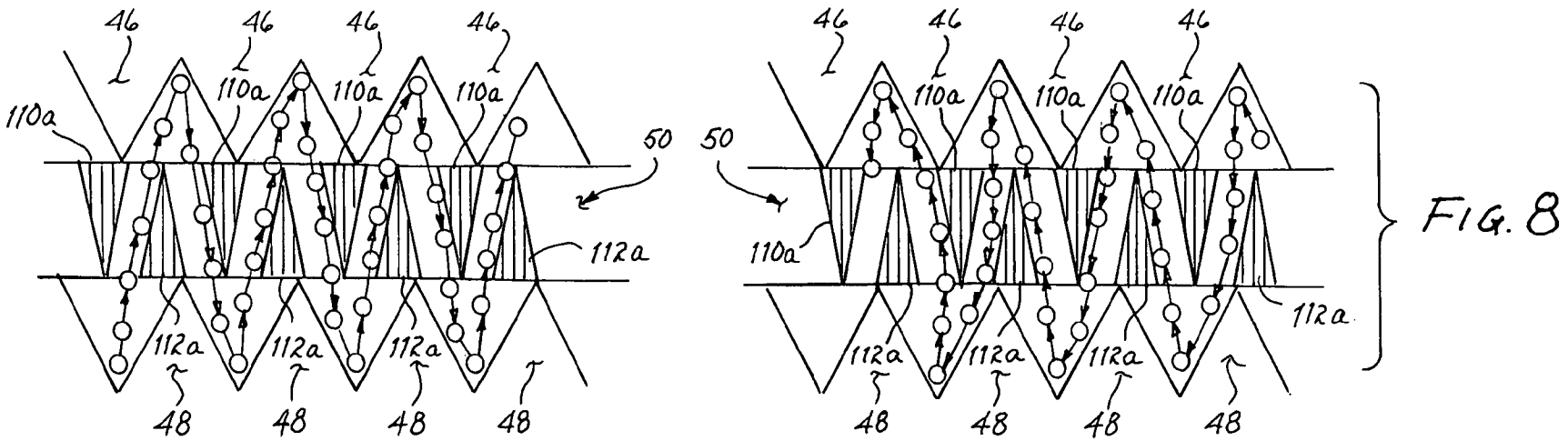
FIG. 8 illustrates an alternative cam for incrementally rotating the nozzle.

Referring to FIG. 8, there is illustrated in simplified form a variant of the saw tooth members and particularly a different configuration of protrusions 110 and 112. Herein, protrusions 110A and 112A are generally adjacent one another whereby the apex of one protrusion is essentially horizontally aligned with the base of an adjacent protrusion. Such arrangement provides for a greater degree of guidance of the pin(s) moving up and down adjacent the protrusions and into the spaces between upper and lower adjacent saw tooth members. Other than this difference, the function, operation and results described above with respect to FIG. 7 are similarly achieved with the configuration shown in FIG. 8.

It may be noted that the degree of angular rotation of nozzle housing 12 is, as stated above, a function of the angular extent of disc 82 between edges 88, 89 of pattern cam 80. To change the angular excursion of nozzle housing 12, an existing pattern cam 80 is readily replaced by another pattern cam having an angularly differently configured disc 82 to increase or decrease the amount of angular rotation of the nozzle housing.

In the past, the orientation of a stream of water emanating from a nozzle was set by carefully aligning the nozzle assembly as a whole with the desired direction. Such alignment was generally of a semi-permanent nature and adjustment was usually quite difficult. Because of such difficulty, workmen tended to have the attitude that "close enough was good enough". Unfortunately, the cleaning capability was usually compromised. With nozzle assembly 10 described herein, such adjustment can be readily and easily made by simply loosening screw 44 (see FIGS. 1 and 2) and rotating cam ring 40 until the water stream produces a fan of ejected water precisely to the area of interest. To set the cam ring, screw 44 is simply tightened.

The invention claimed is:

1. A method of cleaning a swimming pool, the method comprising:

providing a cam operated swimming pool cleaning head and nozzle assembly comprising at least a first and a second saw tooth member within the assembly, each saw tooth member comprising a first side and an opposite side;

vertically translating the nozzle upward and simultaneously incrementally rotating the nozzle clockwise to an extended position in response to application of water pressure within the nozzle, the nozzle being guided in its incremental rotation by the first side of the first saw tooth member;

ejecting a stream of water through an outlet of the nozzle and directing the stream to a surface of the swimming pool when the nozzle is in the extended position;

vertically translating the nozzle downward and simultaneously incrementally rotating the nozzle clockwise from the extended position to a retracted position in response to cessation of the water pressure within the nozzle, the nozzle being guided in its incremental rotation by the first side of the second saw tooth member;

incrementally rotating the nozzle in steps through a predetermined number of degrees each time the nozzle is vertically translated until a predetermined degree of angular rotation is reached;

repositioning a cam reverser operatively associated with the nozzle when the nozzle is vertically translating;

vertically translating the nozzle downward from the extended position to the retracted position and simultaneously incrementally rotating the nozzle counter-clockwise after the cam reverser is repositioned and in response to cessation of the water pressure within the nozzle, the nozzle being guided in its incremental rotation by the opposite side of the second saw tooth member; and vertically translating the nozzle upward to the extended position and simultaneously incrementally rotating the nozzle counter-clockwise in response to application of water pressure within the nozzle, the nozzle being guided in its incremental rotation by the opposite side of the first saw tooth member.

* * * * *